US006199532B1

(12) United States Patent
Häberlein et al.

(10) Patent No.: US 6,199,532 B1
(45) Date of Patent: Mar. 13, 2001

(54) FOUR-STROKE ENGINE

(75) Inventors: Jürgen Häberlein, Murrhardt; Georg Becker, Schwaikheim, both of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/411,242

(22) Filed: Oct. 4, 1999

(30) Foreign Application Priority Data

Oct. 23, 1998 (DE) ..... 198 48 890

(51) Int. Cl.[7] ..... F01M 1/00
(52) U.S. Cl. ..... 123/196 R; 123/311
(58) Field of Search ..... 123/196 R, 196 M, 123/311

(56) References Cited

FOREIGN PATENT DOCUMENTS 3022901 12/1981 (DE) .
3438031 4/1986 (DE) .

*Primary Examiner*—Noah P. Kamen
(74) *Attorney, Agent, or Firm*—Walter Ottesen

(57) ABSTRACT

The invention is directed to a mixture lubricated four-stroke engine having a cylinder and a piston which delimits a combustion chamber in the cylinder. The piston drives a crankshaft via a connecting rod with the crankshaft being journalled in a crankcase. An inlet valve and an outlet valve are provided for the combustion chamber and have respective valve members which are actuated via a valve drive assembly driven by the crankshaft. The inlet valve is connected via an intake channel to a mixture-preparation device. The valve housing is, on the one hand, connected to the crankcase and, on the other hand, is flow connected via a connecting channel to the intake channel. The crankcase is connected to the mixture-preparation device exclusively via the valve housing, the connecting channel and the intake channel. In this way, an adequate lubrication and excellent acceleration performance is ensured with a constructively simple configuration and excellent exhaust-gas quality.

14 Claims, 2 Drawing Sheets

FOUR-STROKE ENGINE

BACKGROUND OF THE INVENTION

A four-stroke combustion engine is disclosed in German patent publication 30 22 901. The intake channel opens exclusively into the crankcase whereby the mixture drawn into the crankcase during the downward movement of the piston is conveyed via a transfer channel into a valve housing from where it flows through the intake valve into the combustion chamber. This mixture passage ensures that the entire air-fuel-lubricant mixture, before entering the combustion chamber, flows through the crankcase and the connecting channels so that the moving parts are lubricated. However, this guiding of the mixture has the disadvantage of causing undesirable heating of the mixture resulting in efficiency losses because of the volumes to be conveyed.

German patent publication 34 38 031 describes a four-stroke engine in which the intake channel of the intake valve is connected directly to the mixture-preparation device. A mixture conduit branches off the intake channel to the crankcase which is connected to the valve housing via a further connecting line parallel to the cylinder wall. The valve housing, in turn, is connected by a connecting channel to the intake channel so that a closed, mixture-conveying circulation is provided, which includes the crankcase and the valve housing. For controlling the mixture-conveying circuit, the mixture conduit to the crankcase is provided with an intake valve, and the connecting channel between the valve housing and the intake channel has a throttle flap. The resulting control of the mixture-conveying lubricant circuit is complex.

SUMMARY OF THE INVENTION

It is an object of the invention to provide an oil-in-fuel lubricated four-stroke engine of the above kind so that the lubrication of all moving parts is ensured while maintaining good output characteristics and having a mechanically simple design.

The oil-in-fuel lubricated four-stroke engine of the invention includes: a cylinder; a piston movably mounted in the cylinder; the cylinder and the piston conjointly delimiting a combustion chamber; the cylinder having an intake opening and an intake valve for opening and closing the intake opening; the cylinder having an exhaust opening and an exhaust valve for opening and closing the exhaust opening; a valve housing connected to the cylinder; the intake valve and the exhaust valve movably mounted in the valve housing; a crankcase connected to the cylinder and communicating with the valve housing; a crankshaft rotatably journalled in the crankcase; a connecting rod interconnecting the piston and the crankshaft; the piston reciprocating in the cylinder to rotatingly drive the crankshaft via the connecting rod and alternately generate an overpressure and an underpressure in the crankcase; a valve drive assembly driven by the crankshaft for actuating the intake valve and the exhaust valve; a mixture-preparation device for supplying an air/fuel-lubricant mixture; an intake channel conducting the mixture to the intake valve; a connecting channel connecting the valve housing to the intake channel; and, the crankcase communicating with the mixture-preparatioil device exclusively via the valve housing, the connecting channel and the intake channel to facilitate movement of at least a portion of the mixture between the crankcase and the intake channel via the valve housing in response to the overpressure and underpressure.

Surprisingly, it was found that a branch line from the intake channel via the valve housing to the crankcase is sufficient to ensure lubrication of all moving parts. The reciprocating piston acts as a suction and pressure pump which discharges a drawn-in air-fuel-lubricant mixture via the connecting channel into the intake channel or takes in a fresh mixture via the connecting channel from the intake channel. Due to the dynamics in the crankcase, the mixture present will mix with fresh mixture components and thus maintain its lubricating properties over the entire service life of the combustion engine. Deterioration of the mixture present in the valve housing and the crankcase is reliably prevented.

Even during sudden accelerations, the mixture is supplied in sufficient amounts to the combustion chamber because, simultaneous to the opening of the intake valve and the intake of a fresh mixture, the mixture drawn by a previous engine stroke into the crankcase and the valve housing is discharged via the connecting channel into the intake channel and flows directly into the combustion chamber. Accordingly, the mixture lubricated four-stroke engine will exhibit a powerful response even for sudden throttle activation. A responsive power output is observed over the entire rpm range.

The flow connection between the crankcase and the valve housing is preferably realized by the valve drive channel so that additional connecting lines are unnecessary.

The flow connections from the crankcase via the valve drive channel to the valve housing and via the connecting channel to the intake channel are free of valves and control elements. The cross section of the connecting channel can be smaller than the intake channel cross section; that is, the cross section of the connecting channel advantageously is approximately 30% to 50%, especially 40%, of the intake channel cross section.

The connecting channel opens into the intake channel in the vicinity of the intake valve so that, especially during acceleration, a readily combustible mixture is present upstream of the intake valve during the intake stroke.

In order to ensure a reliable lubrication of all moving parts independently of the operating position of the engine, the volume of the valve housing and the exchange volume flowing through the connecting channel are adjusted relative to one another such that, during idle operation, fresh mixture components are continuously mixed into the air-fuel-lubricant mixture in the valve housing. This ensures satisfactory lubrication over the entire period of operation.

For such a configuration of the mixture lubricated combustion engine, the amount of the lubricant component of the mixture can be significantly reduced, for example, to a lubricant/fuel ratio of 1:60, 1:100, or less.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
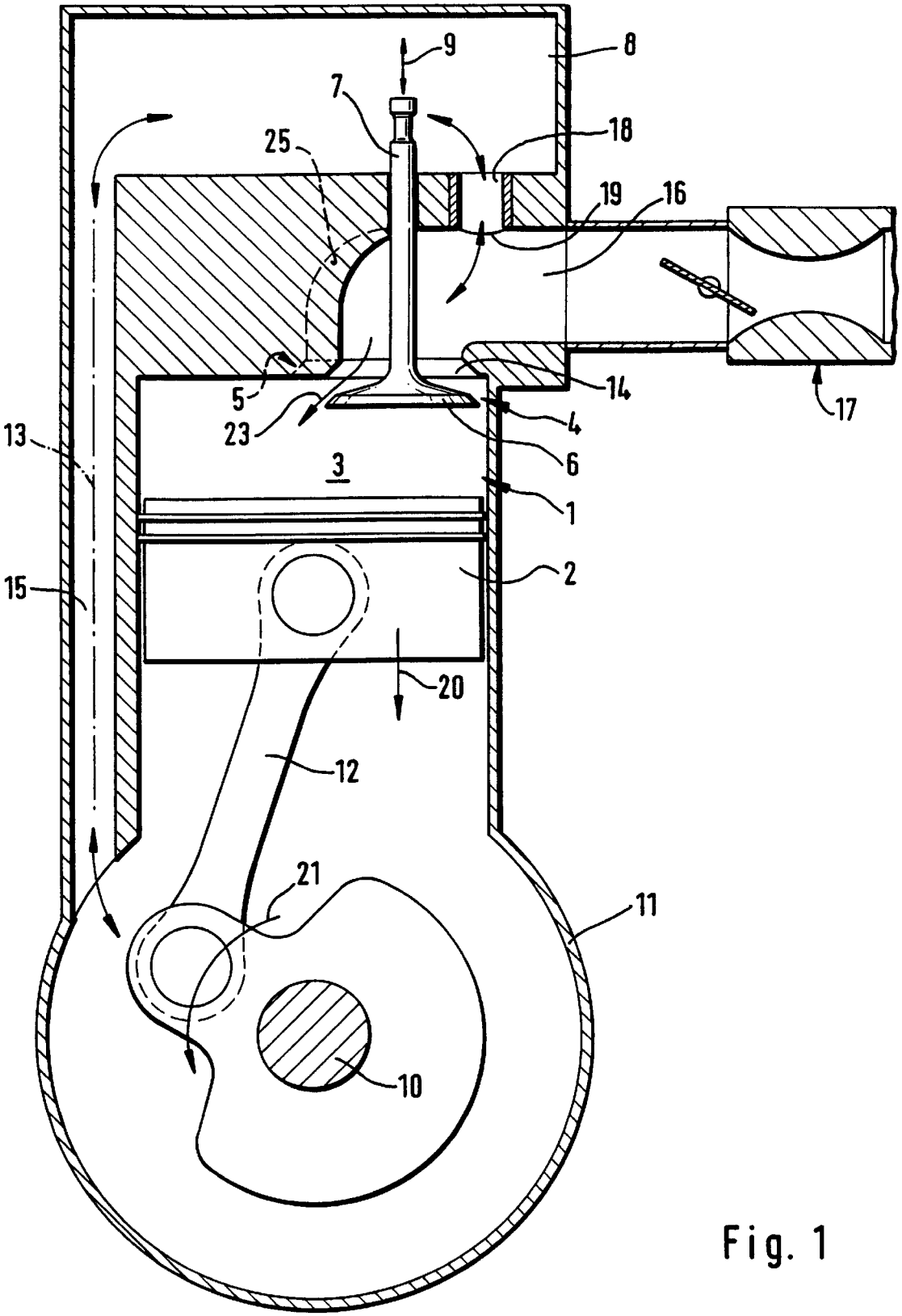
FIG. 1 is a schematic section view of the four-stroke internal combustion engine according to the invention.
Figure 2:
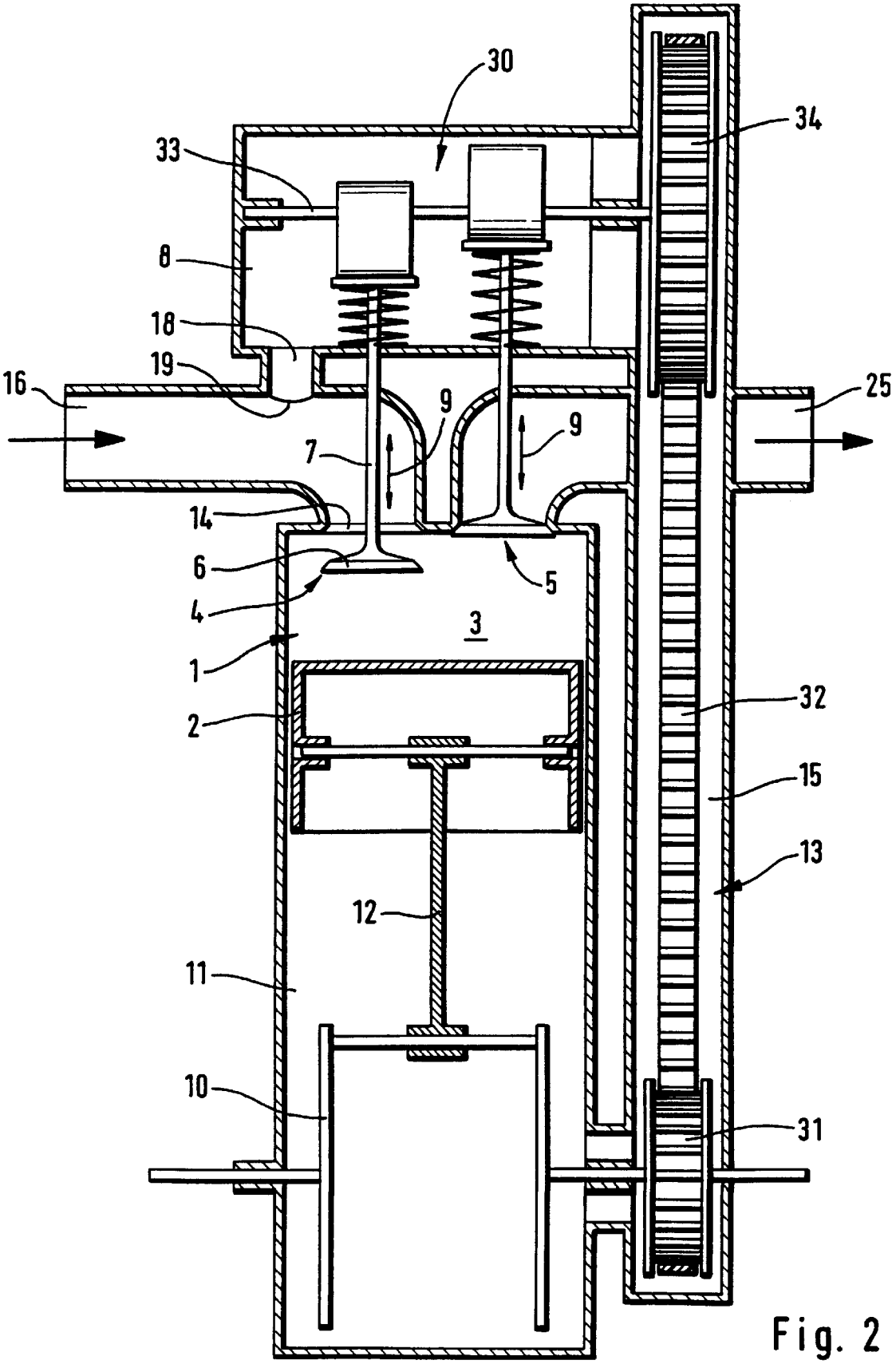
FIG. 2 is another view, in schematic section, of the internal combustion engine of FIG. 1.

The four-stroke engine, schematically shown in section in FIGS. 1 and 2, comprises a cylinder 1 and a piston 2 arranged therein. The piston 2 delimits the combustion chamber 3 formed in the cylinder 1. An intake valve 4 and an exhaust valve 5 are arranged in the cylinder 1 via which a combustible mixture is drawn in and exhaust gas is discharged, respectively. The intake valve 4 shown includes a valve plate 6 and a valve stem 7 projecting into a valve housing 8 in which a cam drive 30 (FIG. 2) reciprocates the valve stem 7 in the direction of arrow 9. The cam drive 30 is driven via a valve drive 13 by the crankshaft 10 rotatingly journalled in the crankcase 11. The crankshaft 10 is connected by connecting rod 12 to the piston 2.

As shown in FIG. 2, the valve drive 13 is a belt or chain drive arranged in a channel 15 which is, at the same time, a flow connection between the crankcase 11 and the valve housing 8. The crankshaft 10 supports a drive wheel 31 for a belt 32 or for a chain. The camshaft 33 of the cam drive 30 supports a pulley 34 for the belt 32 or a sprocket for the chain.

The intake opening 14 of the intake valve 4 extends from an intake channel 16 which connects the intake opening 14 to a mixture-preparation device 17.

In the vicinity of the intake valve 4, the valve housing 8 is connected via a connecting channel 18 to the intake channel 16. The opening 19 of the connecting channel 18 opens into the intake channel 16 approximately opposite the intake opening 14. The opening 19 is rounded, preferably approximately circular.

Because of the selected configuration, the crankcase 11 is connected exclusively via the valve housing 8 and the connecting channel 18 to the intake channel 16 and thus to the mixture-preparation device 17. The flow connection between the crankcase 11 and the valve housing 8 is suitably provided via the channel 15 of the valve drive 13 so that no additional conduits must be provided.

When the intake valve 4 is open and the piston 2 moves downwardly in the direction of arrow 20, an air-fuel-lubricant mixture is drawn in via the intake channel 16 from the mixture-preparation device 17. During the compression stroke following the intake stroke, the piston 2 moves upwardly counter to the direction of arrow 20 with the intake valve 4 as well as the exhaust valve 5 being closed. The upward movement of the piston 2 produces an underpressure in the crankcase 11, which is also present in the valve housing 8 via the channel 15 of the valve drive 13, so that an air-fuel-lubricant mixture is drawn in from the intake channel 16 via the connecting channel 18 into the valve housing 8 and also via the channel 15 into the crankcase 11. This air-fuel-lubricant mixture lubricates the moving parts of, for example, the valve drive 13 and the crankshaft 10 with the connecting rod 12 and the piston 2.

At the end of the compression stroke, the ignition takes place and therefore the power stroke in which the crankshaft 10 is driven in the direction of arrow 21. After completion of the power stroke, the exhaust valve 5 opens and the gases present within the combustion chamber 3 are discharged via the exhaust channel 25. In the subsequent intake stroke, the piston 2 again moves downwardly in the direction of arrow 20, causing an overpressure to build up in the crankcase 11 which conveys the air-fuel-lubricant mixture, drawn in during the previous strokes, via the channel 15 of the valve drive 13 to the valve housing 8. Thereafter, the mixture is discharged via the connecting channel 18 into the intake channel 16. The discharged mixture mixes with the air-fuel-lubricant mixture flowing into the combustion chamber 3 in the direction of arrow 23 and enters the combustion chamber 3. During a subsequent upward movement of the piston 2, the underpressure now building up in the crankcase 11 is compensated by taking in the new mixture from the intake channel 16. Fresh air-fuel-lubricant mixture flows via the connecting channel 18 into the valve housing 8, lubricates the valve drive 13, and flows through the valve drive channel 15 into the crankcase 11 in order to lubricate parts mounted therein.

Because of the reciprocating movement of the piston 2, the configuration of the invention provides for a cyclical exchange of the volumes in the crankcase 11, the valve drive channel 15, and the valve housing 8 via the connecting channel 18. The connecting channel 18 can, in this embodiment, be configured without valves. The connecting channel 18 has a flow cross section which is preferably less than that of the intake channel 16, especially the cross section of the connecting channel is approximately 30% to 50%, preferably approximately 40%, of the intake channel cross section.

In a further embodiment of the invention, the volume of the valve housing 8 and the exchange volume flowing via the connecting channel 18 are adjusted relative to one another such that, during operation of the combustion engine, fresh mixture components are supplied with each stroke of the piston 2 to the air-fuel-lubricant mixture in the valve housing 8. Due to the dynamics within the crankcase 11, the fresh mixture components mix thoroughly with the mixture already present. In this way, at any time a mixture of a quality is provided that ensures sufficient lubrication of all moving parts. Accordingly, the lubricant component of the mixture can be substantially lowered to a ratio of, for example, 1:100.

In a preferred embodiment, the volume of the flow connection from the crankcase 11 to the valve housing 8, that is, the sum total of the volume of the channel 15, the volume of the valve housing 8, and the volume of the connecting channel 18 from the valve housing 8 to the intake channel 16, can be smaller, preferably substantially smaller, than the volume in the crankcase displaced by the piston 2.

The disclosed mixture-lubricated four-stroke engine has a displacement of less than 250 $cm^3$, preferably approximately 20 $cm^3$ to 100 $cm^3$ and is especially well suited for use in handheld, especially in portable, handheld work tools.

It is understood that the foregoing description is that of the preferred embodiments of the invention and that various changes and modifications may be made thereto without departing from the spirit and scope of the invention as defined in the appended claims.

What is claimed is:

1. An oil-in-fuel lubricated four-stroke engine comprising:

a cylinder;

a piston movably mounted in said cylinder;

said cylinder and said piston conjointly delimiting a combustion chamber;

said cylinder having an intake opening and an intake valve for opening and closing said intake opening;

said cylinder having an exhaust opening and an exhaust valve for opening and closing said exhaust opening;

a valve housing connected to said cylinder;

said intake valve and said exhaust valve movably mounted in said valve housing;

a crankcase connected to said cylinder and communicating with said valve housing;

a crankshaft rotatably journalled in said crankcase;

a connecting rod interconnecting said piston and said crankshaft;

said piston reciprocating in said cylinder to rotatingly drive said crankshaft via said connecting rod and alternately generate an overpressure and an underpressure in said crankcase;

a valve drive assembly driven by said crankshaft for actuating said intake valve and said exhaust valve;

a mixture-preparation device for supplying an air/fuel-lubricant mixture;

an intake channel conducting said mixture to said intake valve;

a connecting channel connecting said valve housing to said intake channel; and, said crankcase communicating with said mixture-preparation device exclusively via said valve housing, said connecting channel and said intake channel to facilitate movement of at least a portion of said mixture between said crankcase and said intake channel via said valve housing in response to said overpressure and said underpressure.

2. The four-stroke engine of claim 1, said valve housing including a channel communicating with said crankcase to permit said portion of said mixture to flow therethrough and to accommodate said drive assembly.

3. The four-stroke engine of claim 2, said channel of said valve housing being free of a valve.

4. The four-stroke engine of claim 1, said intake channel having a flow cross section; and, said connecting channel having a flow cross section less than said flow cross section of said intake channel.

5. The four-stroke engine of claim 4, said flow cross section of said connecting channel being approximately 30% to 50% of said flow cross section of said intake channel.

6. The four-stroke engine of claim 5, said flow cross section of said connecting channel being approximately 40% of said flow cross section of said intake channel.

7. The four-stroke engine of claim 1, said connecting channel having a mouth opening into said intake channel proximal to said intake valve.

8. The four-stroke engine of claim 7, said mouth opening into said intake channel approximately opposite said intake opening.

9. The four-stroke engine of claim 7, said mouth being rounded.

10. The four-stroke engine of claim 7, said mouth being circular.

11. The four-stroke engine of claim 1, said valve housing having a volume matched to an exchange volume flowing through said connecting channel during operation of said engine such that fresh air/fuel-lubricant mixture components are constantly admixed to an air/fuel-lubricant mixture present in said valve housing.

12. The four-stroke engine of claim 1, said connecting channel being free of a valve.

13. The four-stroke engine of claim 1, said engine having a displacement of less than 250 $cm^3$.

14. The four-stroke engine of claim 13, said engine having a displacement of approximately 20 $cm^3$ to 100 $cm^3$.

* * * * *